United States Patent [19]

Husain et al.

[11] Patent Number: 4,750,333

[45] Date of Patent: Jun. 14, 1988

[54] INTEGRATED MINE COOLING AND WATER CONDITIONING SYSTEM

[75] Inventors: Matloob Husain, Wheaton; James A. Nail, Carol Stream, both of Ill.

[73] Assignee: Chicago Bridge & Iron Company, Oak Brook, Ill.

[21] Appl. No.: 538,084

[22] Filed: Oct. 3, 1983

[51] Int. Cl.[4] ..... F25D 17/02

[52] U.S. Cl. ..... 62/118; 62/123; 62/260; 62/332; 62/434; 62/532; 165/45; 165/104.22; 60/639

[58] Field of Search ..... 165/45, 104.22; 62/118, 62/260, 332, 434, 123, 532; 60/639; 98/50

[56] References Cited

U.S. PATENT DOCUMENTS

| | | | |
|---|---|---|---|
| 2,525,045 | 10/1950 | Richardson | 98/50 |
| 3,247,678 | 4/1966 | Mohlman | 62/434 |
| 3,605,426 | 9/1971 | Chao et al. | 62/123 |
| 3,906,742 | 9/1975 | Newton | 62/332 |
| 4,286,436 | 9/1981 | Engdahl et al. | 62/123 |
| 4,341,085 | 7/1982 | Nail | 62/124 |
| 4,385,497 | 5/1983 | Scott | 60/639 |

FOREIGN PATENT DOCUMENTS

| | | |
|---|---|---|
| 546133 | 10/1930 | Fed. Rep. of Germany . |
| 1051764 | 12/1952 | Fed. Rep. of Germany . |
| 2631754 | 1/1978 | Fed. Rep. of Germany . |
| 759035 | 10/1956 | United Kingdom . |
| 617608 | 7/1978 | U.S.S.R. . |

*Primary Examiner*—Ronald C. Capossela

*Attorney, Agent, or Firm*—Marshall, O'Toole, Gerstein, Murray & Bicknell

[57] ABSTRACT

A method and apparatus for cooling an aqueous liquid at ground level, by a refrigeration system which rejects heat, to produce an aqueous ice slurry of ice crystals in the aqueous liquid; and (A) feeding some of the aqueous ice slurry from ground level to a heat exchanger in a mine chamber substantially below ground level to cool air or water in the mine chamber by heat exchange with the slurry thereby producing warm aqueous liquid from the slurry; withdrawing the warm aqueous liquid from the mine chamber, returning it to ground level and then cooling the aqueous liquid by the refrigeration system to again convert it to an aqueous ice slurry; and recycling the slurry to the mine chamber; and (B) feeding some of the aqueous ice slurry produced at ground level to an ice washer and washing the ice; melting the washed ice to produce potable water at ground level; and feeding the potable water to hydraulic powered machinery in the mine chamber and using the hydrostatic energy of the water to power the machinery.

24 Claims, 1 Drawing Sheet

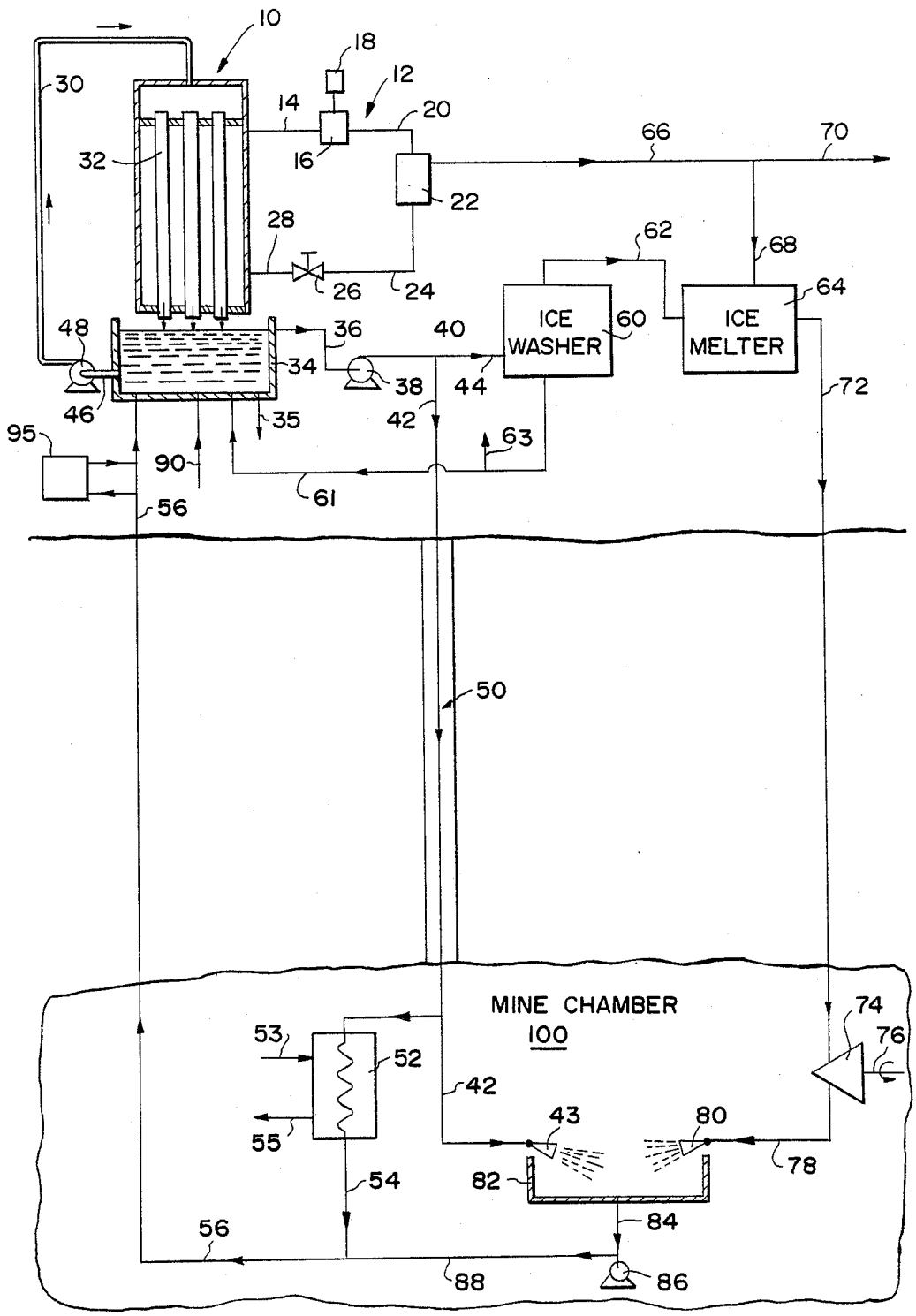
10
18
12
30
14
20
66
70
32
16
22
28
62
68
26
24
64
48
36
40
ICE WASHER
60
ICE MELTER
34
38
44
72
46
35
42
63
95
90
61
56
50
MINE CHAMBER
100
74
76
53
52
42
43
80
55
78
54
82
84
56
88
86

INTEGRATED MINE COOLING AND WATER CONDITIONING SYSTEM

This invention relates to apparatus and methods of cooling underground locations and powering machinery at such locations. More particularly, this invention is concerned with apparatus for cooling an underground mine chamber by use of an ice slurry, the production of portable water from the ice slurry and use of the hydrostatic energy of the water to power hydraulic machinery in the mine chamber.

BACKGROUND OF THE INVENTION

In many areas of the world the search for and production of various minerals, ores and diamonds has led to locations substantially below ground level or the surface of the earth. This is especially so in diamond mines where the mine chambers are thousands of feet below ground level.

One of the many problems inherent in deep underground mines is the increased temperature of the earth as the depth from the surface increases. Temperatures in many deep mines are normally over 100° F. and others would readily reach 120° to 140° F. unless they were cooled by one means or another.

Cooling deep mine chambers by pumping cold air down to them from the surface is often impractical because ambient air at ground level is not always cold at the mine location. In addition, the air often arrives at the mine chamber at a temperature insufficiently low to provide much cooling. Furthermore, moving air is energy intensive and thus costly.

An alternative way to cool deep mine chambers is to pump cold water to the chamber from ground level. The heat absorbed in the chamber warms the cold water. The warm water must then be pumped above ground and then be sent to waste or recooled for reuse. This method involves pumping large volumes of water with heavy capital investment and high energy consumption. Furthermore, cold water does not provide high cooling efficiency since only sensible heat absorbtion is involved.

In addition to cooling deep mine chambers, it may be desirable to have a source of relatively high pressure liquid to drive hydraulic powered machinery in the chamber. Pressurized water is the preferred liquid because it is safe to use and relatively low cost. However, water of sufficiently good quality for use in powering hydraulic machinery is not available in many mine areas. It must therefore be brought in or local water treated at substantial expense to raise it to acceptable quality.

It is believed clear from the above discussion that improved or alternative methods and apparatus would be useful to cool locations substantially below ground level and to provide such locations with water suitable for driving hydraulic machinery.

SUMMARY OF THE INVENTION

According to one aspect of the invention, a method is provided comprising cooling an aqueous liquid at ground level, by means of a refrigeration system which rejects heat, to produce an aqueous ice slurry of ice crystals in the aqueous liquid; feeding the aqueous ice slurry from ground level to a location substantially below ground level to cool that location by heat exchange with the slurry, thereby producing warm aqueous liquid; withdrawing the warm aqueous liquid from the location, returning it to ground level and then cooling the aqueous liquid by means of the refrigeration system to again convert it to an aqueous ice slurry; and recycling the slurry to the location substantially below ground level.

According to a second aspect of the invention, a method is provided comprising cooling an aqueous liquid at ground level, by means of a refrigeration system which rejects heat, to produce an aqueous ice slurry of ice crystals in the aqueous liquid; feeding some of the aqueous ice slurry produced at ground level to an ice washer and washing the ice; melting the washed ice to produce potable water at ground level; and feeding the potable water to hydraulic powered machinery at a location substantially below ground level and using the hydrostatic energy of the water to power the machinery.

It is also within the scope of the invention to combine both of the described methods into an integrated or overall method.

The location underground can be a mine chamber, or a mine chamber containing a heat exchanger. The aqueous ice slurry can be sprayed directly into the mine chamber. Alternatively, the slurry can be fed through a heat exchanger in the chamber to cool the atmosphere or air in the chamber, or local water in the chamber, by indirect heat exchange with the aqueous ice slurry thereby producing the warm aqueous liquid.

After the washed ice is produced, heat rejected from the refrigeration system can be used to melt the ice to form the potable water.

The spent but still cold water from the hydraulic machinery can be used to cool the mine chamber. The water can then be returned to the freeze exchanger to be cooled and recycled.

According to a third aspect of the invention, apparatus is provided comprising freeze exchanger means at ground level in which an aqueous liquid is cooled to produce ice crystals and form an aqueous liquid ice slurry; conduit means for feeding the ice slurry from ground level to an underground location substantially below ground level to cool the underground location by heat exchange therewith and produce warm aqueous liquid; and conduit means for removing the warm aqueous liquid from the underground location and returning it to the freeze exchanger.

According to a fourth aspect of the invention, apparatus is provided comprising freeze exchanger means at ground level in which an aqueous liquid is cooled to produce ice crystals and form an aqueous liquid ice slurry; conduit means for delivering the ice slurry to an ice washer; conduit means for delivering washed ice from the ice washer to an ice melter at ground level; and conduit means for delivering water from the ice melter to hydraulic powered machinery in the location substantially below ground level to power the machinery by use of the hydrostatic pressure of the water.

The invention also includes within its scope combining the apparatus of the third and fourth aspects of the invention into an integrated apparatus combination made up of those elements.

It is desirable to position as such as possible of the apparatus at or above ground level so that heat developed in the system can be rejected to the atmosphere and not warm the underground location or mine chamber. Furthermore, the apparatus is more readily operated and maintained above, rather than below, ground level.

Any suitable refrigerant gas can be used in the apparatus and in practicing the method, although ammonia is particularly satisfactory.

A large number of aqeous liquids can be used in the apparatus and method, including water, brine (water plus sodium chloride, with or without other minerals, metals or salts) and a mixture of water and ethylene glycol or other aqueous solutions. Brine is presently the liquid of choice since the ice formed when it is used has a desirable crystal size, flows well and permits brine to drain through it rapidly.

BRIEF DESCRIPTION OF THE DRAWING

The attached drawing schematically illustrates a combination of apparatus according to the invention for cooling an underground mine chamber and providing water for powering hydraulic machinery in the chamber.

DETAILED DESCRIPTION OF THE DRAWING

To the extent it is reasonable and practical, the same or similar elements or parts which appear in the various views of the drawings will be identified by the same numbers.

In the subsequent discussion the invention will be described in conjunction with the use of a brine as the working aqueous liquid. By "brine" is meant an aqueous solution of sodium chloride.

With reference to the drawing, the freeze exchanger 10, located at or above ground level, is of the vertical shell and tube falling film type such as disclosed in U.S. Pat. No. 4,286,436. The shell side of the freeze exchanger 10 is cooled by means of a closed loop refrigeration system 12. A gaseous refrigerant, such as ammonia, is removed from the shell side of freeze exchanger 10 by conduit 14 and fed to compressor 16 driven by electric motor 18. The compressed refrigerant is fed from compressor 16 to conduit 20 which delivers it to condenser 22. The liquid refrigerant is removed from condenser 22 by conduit 24 and delivered to Joule-Thompson valve 26 through which it is expanded to conduit 28 for delivery to the shell side of freeze exchanger 10.

Brine fed by conduit 30 to the top of freeze exchanger 10 flows as a thin falling film down the inner surface of the tubes 32. As the brine flows downwardly in the tubes it is cooled and a portion of the water comprising the aqueous solution of salt is converted to small ice crystals. The mixture of brine and ice flows out the ends of the tubes 32 into slurry receiving tank 34 located at or above ground level.

The ice floats to the top in receiving tank 34 and is withdrawn therefrom as a slurry by conduit 36 and fed to pump 38 which delivers it to conduit 40 to be fed entirely to conduit 42, or entirely to conduit 44, or part to both of conduits 42 and 44. Any make-up brine needed in the system can be introduced by conduit 90 into receiving tank 34. Brine in the lower part of receiving tank 34 is withdrawn by conduit 46 and fed to pump 48 which delivers it to conduit 30 for delivery to the top of freeze exchanger 10. The described method of ice slurry formation can continue as long as desired. Solids which precipitate out in the ice formation and settle to the bottom of tank 34 can be removed therefrom through conduit 35.

The ice slurry produced as described can be used entirely for cooling underground mine chamber 100 by directing all of the slurry from conduit 40 to conduit 42, which can run down mine shaft 50 and then be sprayed out sprayhead 43 directly into the atmosphere and surfaces of chamber 100 to thereby cool the chamber. The water can be collected in pan 82 and be recycled by conduit 84, pump 86 and conduits 88 and 56 to receiving tank 34. Simultaneously or alternatively ice slurry can be fed from conduit 42 to heat exchanger 52. Warm ambient air or local water in the mine chamber can be fed into heat exchanger 52 by conduit 53 and be removed therefrom cold through conduit 55. The resulting cold air or cold water can then be used for cooling purposes. The ice slurry fed to heat exchanger 52 is converted to a warm aqueous liquid or brine. The warm brine is withdrawn from heat exchanger 52 by conduit 54 and fed to conduit 56 which returns it to receiving tank 34 to be reused in forming ice slurry. Very little power consumption is required to return the water by conduit 56 to receiving tank 34 when conduit 42 feeds the slurry through heat exchanger 52 to conduit 54 because the force applied by the liquid in conduits 42, 54 essentially balances the liquid head in conduit 56. Power consumption to return the water to receiving tank 34 is accordingly nearly limited to that needed to overcome liquid friction with the conduit surfaces.

It is far more efficient to feed an ice slurry, instead of cold water, through heat exchanger 52 because the heat of fusion needed to convert ice to water provides a much greater cooling capacity than is obtained with cold water which requires only sensible heat to warm it. A further inherent advantage in using an ice slurry rather than cold water or brine alone is in the reduced volume of liquid which must be supplied from above ground to the heat exchanger in the underground mine chamber and then returned to ground level.

Instead of using the ice slurry solely to cool the mine chamber, part of all of the ice slurry can be used as a source of potable water having a quality suitable for use in driving any hydraulic powered machinery in the underground mine chamber. Thus, the ice slurry can be fed from conduit 40 to conduit 44 for delivery to ice washer 60 located at or above ground level. Ice washer 60 can be of any suitable type, but desirably is such that the ice floats on a volume of brine. As the ice pack or layer rises, it is washed by spraying potable water onto the pack from above. One suitable ice washer of this type is disclosed in U.S. Pat. No. 1,341,085.

The brine and drain water are removed from washer 60 by conduit 61 and returned, at least in part, to the slurry receiving tank 34. However, some of the brine can be diverted from conduit 61 into conduit 63 and then discarded to maintain a desired brine concentration by preventing salt build-up.

The washed ice is removed from washer 60 by conduit 62 and delivered to ice melter 64 located at or above ground level. Heat rejected from refrigerant condenser 22 can be conveyed by conduit 66 entirely to conduit 68, or partly to conduit 68 and partly to conduit 70, or entirely to conduit 70. When fed to conduit 70 the heat is rejected to the atmosphere. However, heat directed to conduit 68 is directed to ice melter 64 to melt the washed ice and produce potable water of a quality high enough to be used to power hydraulic machinery.

The cold potable water is withdrawn from ice melter 64 above ground level by conduit 72 and fed to hydraulic machinery 74 located in mine chamber 100. The hydrostatic energy possessed by the water in flowing from ground level to the mine chamber is substantial because of the depth at which many mine chambers 100 are located. Substantial power is accordingly available to drive the hydraulic machinery and power shaft 76.

The exhaust or spent water from hydraulic machinery 74 is still cold so, if desired, it can be fed to conduit 78 and sprayed out spray head 80 into the atmosphere and/or against the surfaces of chamber 100 to provide cooling in the mine chamber. The water from spray 80 can be collected in pan 82 for reuse. Thus, the water in pan 82 can be withdrawn through conduit 84 and fed to pump 86. From pump 86 the water can be fed to conduit 88 and delivered to conduit 56 for return to slurry receiving tank 34.

The water collected in pan 82 may acquire a significant amount of dissolved and suspended material as a result of contact with the mine chamber surfaces. Accordingly, it is an optional feature of the invention to send some or all of the water being returned by conduit 56 through a water treatment facility 95 before the water is returned to slurry receiving tank 34. The type of water treatment facility used is considered within the skill of the art but will depend on the physical and chemical nature of the material in the water.

The foregoing detailed description has been given for clearness of understanding only, and no unnecessary limitations should be understood therefrom, as modifications will be obvious to those skilled in the art.

What is claimed is:

1. A method comprising:

cooling an aqueous liquid at ground level, by means of a refrigeration system which rejects heat, to produce an aqueous ice slurry of ice crystals in the aqueous liquid;

separating ice from some of the aqueous ice slurry produced at ground level, washing the ice and melting the ice to produce potable water at ground level, and using the potable water hydrostatic energy to power hydraulic machinery at the location below ground level;

feeding the aqueous ice slurry from ground level to a location substantially below ground level to cool that location by heat exchange with the slurry, thereby producing warm aqueous liquid;

withdrawing the warm aqueous liquid from the location, returning it to ground level and then cooling the aqueous liquid by means of the refrigeration system to again convert it to an aqueous ice slurry; and recycling the slurry to the location substantially below ground level.

2. A method according to claim 1 in which heat rejected from the refrigeration system is used to melt the ice to form potable water.

3. A method according to claim 1 in which the water, after powering the hydraulic machinery, is returned to ground level and cooled again to produce an aqueous liquid ice slurry.

4. A method according to claim 1 in which spent water from the hydraulic machinery is used to cool the mine chamber and the water is then returned to the freese exchanger to be cooled and recycled in the method.

5. A method comprising:

cooling an aqueous liquid at ground level, by means of a refrigeration system which rejects heat, to produce an aqueous ice slurry of ice crystals in the aqueous liquid; and (A) feeding some of the aqueous ice slurry from ground level to a heat exchanger in a mine chamber substantially below ground level to cool air or water in the mine chamber by indirect heat exchange with the slurry thereby producing warm aqueous liquid from the slurry;

withdrawing the warm aqueous liquid from the mine chamber, returning it to ground level and then cooling the aqueous liquid by means of the refrigeration system to again convert it to an aqueous ice slurry; and recycling the slurry to the mine chamber; and (B) feeding some of the aqueous ice slurry produced at ground level to an ice washer and washing the ice;

melting the washed ice to produce potable water at ground level; and feeding the potable water to hydraulic powered machinery in the mine chamber and using the hydrostatic energy of the water to power the machinery.

6. A method according to claim 5 in which heat rejected from the refrigeration system is used to melt the ice to form potable water.

7. A method according to claim 5 in which the water, after powering the hydraulic machinery, is returned to ground level and cooled again to produce an aqueous liquid ice slurry.

8. A method according to claim 5 in which spent water from the hydraulic machinery is used to cool the mine chamber and the water is then returned to the freeze exchanger to be cooled and recycled in the method.

9. A method comprising:

cooling an aqueous liquid at ground level, by means of a refrigeration system which rejects heat, to produce an aqueous ice slurry of ice crystals in the aqueous liquid;

feeding some of the aqueous ice slurry produced at ground level to an ice washer and washing the ice;

melting the washed ice to produce potable water at ground level; and feeding the potable water to hydraulic powered machinery at a location substantially below ground level and using the hydrostatic energy of the water to power the machinery.

10. A method according to claim 9 in which heat rejected from the refrigeration system is used to melt the ice to form potable water.

11. A method according to claim 9 in which the water, after powering the hydraulic machinery, is returned to ground level and cooled again to produce an aqueous liquid ice slurry.

12. A method according to claim 9 in which the location below ground level is a mine chamber, the spent water from the hydraulic machinery is used to cool the mine chamber and the water is then returned to the freeze exchanger to be cooled and recycled in the method.

13. Apparatus comprising, in combination:

freeze exchanger means at ground level in which an aqueous liquid is cooled to produce ice crystals and form an aqueous liquid ice slurry; and (A) conduit means for feeding some of the ice slurry from ground level to a heat exchanger in an underground mine chamber substantially below ground level to cool air or water in the mine chamber by indirect heat exchange with the slurry thereby producing warm aqueous liquid; and conduit means for removing the warm aqueous liquid from the mine chamber and returning it to the freeze exchanger, and (B) conduit means for delivering some of the ice slurry to an ice washer;

conduit means for delivering washed ice from the ice washer to an ice melter at ground level; and conduit means for delivering water from the ice melter to hydraulic powered machinery in the location substantially below ground level to power the machinery by use of the hydrostatic pressure of the water.

14. Apparatus according to claim 13 including:

means to collect spent water from the hydraulic machinery and return it to the freeze exchanger.

15. Apparatus according to claim 13 including:

means to spray spent water from the hydraulic machinery into the mine chamber for cooling therein.

16. Apparatus according to claim 13 including means to melt the washed ice by using heat rejected from a refrigeration system.

17. Apparatus comprising, in combination:

freeze exchanger means at ground level in which an aqueous liquid is cooled to produce ice crystals and form an aqueous liquid ice slurry;

conduit means for delivering the ice slurry to an ice washer;

conduit means for delivering washed ice from the ice washer to an ice melter at ground level; and conduit means for delivering water from the ice melter to hydraulic powered machinery at a location substantially below ground level to power the machinery by use of the hydrostatic pressure of the water.

18. Apparatus according to claim 17 including:

means to collect spent water from the hydraulic machinery and return it to the freeze exchanger.

19. Apparatus according to claim 17 in which the location below ground level is a mine chamber and means is provided to spray spent water from the hydraulic machinery into the mine chamber for cooling therein.

20. Apparatus according to claim 17 including means to melt the washed ice by using heat rejected from a refrigeration system.

21. Apparatus comprising, in combination:

freeze exchanger means at ground level in which an aqueous liquid is cooled to produce ice crystals and form an aqueous liquid ice slurry;

conduit means for delivering some of the ice slurry to an ice washer;

conduit means for delivering washed ice from the ice washer to an ice melter at ground level;

conduit means for delivering water from the ice melter to hydraulic powered machinery in a mine chamber substantially below ground level to power machinery in the mine chamber by use of the hydrostatic pressure of the water;

conduit means for feeding the ice slurry from ground level to the mine chamber to cool the mine chamber by heat exchange therewith and produce warm aqueous liquid; and conduit means for removing the warm aqueous liquid from the mine chamber and returning it to the freeze exchanger.

22. Apparatus comprising, in combination:

freeze exchanger means at ground level in which an aqueous liquid is cooled to produce ice crystals and form an aqueous liquid ice slurry;

conduit means for delivering some of the ice slurry to an ice washer;

conduit means for delivering washed ice from the ice washer to an ice melter at ground level;

conduit means for delivering water from the ice melter to hydraulic powered machinery in a location substantially below ground level to power machinery therein by use of the hydrostatic pressure of the water;

means to collect spent water from the hydraulic machinery and return it to the freeze exchanger;

conduit means for feeding ice slurry from ground level to the underground location to cool the underground location by heat exchange therewith and produce warm aqueous liquid; and conduit means for removing the warm aqueous liquid from the underground location and returning it to the freeze exchanger.

23. Apparatus comprising, in combination:

freeze exchanger means at ground level in which an aqueous liquid is cooled to produce ice crystals and form an aqueous liquid ice slurry;

conduit means for delivering some of the ice slurry to an ice washer;

conduit means for delivering washed ice from the ice washer to an ice melter at ground level;

conduit means for delivering water from the ice melter to hydraulic powered machinery in a location substantially below ground level to power the machinery by use of the hydrostatic pressure of the water;

means to spray spent water from the hydraulic machinery into the underground location for cooling therein;

conduit means for feeding ice slurry from ground level to an underground location substantially below ground level to cool the underground location by heat exchange therewith and produce warm aqueous liquid; and conduit means for removing the warm aqueous liquid from the underground location and returning it to the freeze exchanger.

24. Apparatus comprising, in combination, a refrigeration system which rejects heat including freeze exchanger means at ground level in which an aqueous liquid is cooled to produce ice crystals and form an aqueous liquid ice slurry;

conduit means for delivering some of the ice slurry to an ice washer;

conduit means for delivering washed ice from the ice washer to an ice melter at ground level;

conduit means for delivering water from the ice melter to hydraulic powered machinery in the location substantially below ground level to power the machinery by use of the hydrostatic pressure of the water;

means to melt the washed ice by using heat rejected from the refrigeration system;

conduit means for feeding the ice slurry from ground level to an underground location substantially below ground level to cool the underground location by heat exchange therewith and produce warm aqueous liquid; and conduit means for removing the warm aqueous liquid from the underground location and returning it to the freeze exchanger.

* * * * *

UNITED STATES PATENT AND TRADEMARK OFFICE

CERTIFICATE OF CORRECTION

PATENT NO. : 4,750,333

DATED : June 14, 1988

INVENTOR(S) : Matloob Husain et al

It is certified that error appears in the above-identified patent and that said Letters Patent is hereby corrected as shown below:

Column 1, line 10, "portable" should read --potable--;

Column 2, line 64, "such" should read --much--;

Column 4, line 39, "of" (first occurrence) should read --or--;line 49, "1,341,085" should read --4,341,085--.

Signed and Sealed this

Twenty-fifth Day of October, 1988

*Attest:*

DONALD J. QUIGG

*Attesting Officer*

*Commissioner of Patents and Trademarks*